US012024843B1

(12) United States Patent
Li et al.

(10) Patent No.: US 12,024,843 B1
(45) Date of Patent: Jul. 2, 2024

(54) ANTI-ICE PUSHING/PULLING DEVICE INSTALLED ON SLOPE OF EARTH-ROCK DAM AND ICE THRUST CALCULATION METHOD

(71) Applicant: NANJING HYDRAULIC RESEARCH INSTITUTE, Suzhou (CN)

(72) Inventors: Zhuo Li, Jiangsu (CN); Changsheng Gao, Jiangsu (CN); Xinyi Liu, Jiangsu (CN); Kai Zhang, Jiangsu (CN); Haipeng Wang, Jiangsu (CN); Jingdong Jiang, Jiangsu (CN); Chaoda Bi, Jiangsu (CN); Guangya Fan, Jiangsu (CN); Xin Jiang, Jiangsu (CN)

(73) Assignee: NANJING HYDRAULIC RESEARCH INSTITUTE, Jiangsu (CN)

( * ) Notice: Subject to any disclaimer, the term of this patent is extended or adjusted under 35 U.S.C. 154(b) by 0 days.

(21) Appl. No.: 18/451,120

(22) Filed: Aug. 17, 2023

(30) Foreign Application Priority Data

Dec. 27, 2022 (CN) ..... 202211681117.1

(51) Int. Cl.
*E02B 3/14* (2006.01)
*E02B 7/06* (2006.01)

(52) U.S. Cl.
CPC ..... *E02B 7/06* (2013.01)

(58) Field of Classification Search
CPC ..... E02B 3/122; E02B 3/123; E02B 3/129; E02B 3/14; E02B 7/06
See application file for complete search history.

(56) References Cited

U.S. PATENT DOCUMENTS 1,112,018 A * 9/1914 McGillivray ..... E02B 3/123 405/20
1,885,470 A * 11/1932 Noetzili ..... E02B 7/06 405/116
2,949,743 A * 8/1960 Wolff ..... E02B 7/06 405/107
6,079,902 A * 6/2000 Pettee, Jr. ..... E02B 3/14 405/20

(Continued)

FOREIGN PATENT DOCUMENTS

CN 106436646 A * 2/2017 ..... E02B 3/14
CN 107152009 A * 9/2017 ..... C04B 28/00

*Primary Examiner* — Benjamin F Fiorello
(74) *Attorney, Agent, or Firm* — JCIPRNET

(57) ABSTRACT

The present invention includes an anti-ice pushing/pulling device installed on the slope of an earth-rock dam and an ice thrust calculation method. The device is arranged in a groove formed on the surface of an upstream slope of the earth-rock dam in the winter water level change area, and includes an upper concrete slab and a lower concrete slab hinged by means of a rotating shaft structure, where the rotating shaft structure is located at the end of the groove in the dam slope far away from the dam crest; a jack is arranged between the two concrete slabs to adjust the flip angle of the upper concrete slab; a plurality of rectangular grooves are formed on the surface of the upper concrete slab, and a combined structure formed by splicing concrete blocks is arranged in the rectangular grooves; and holes are formed on the concrete blocks.

5 Claims, 4 Drawing Sheets

(56) References Cited

U.S. PATENT DOCUMENTS

| | | | | |
|---|---|---|---|---|
| 6,267,533 | B1 * | 7/2001 | Bourg | E02B 3/04 405/16 |
| 6,955,500 | B1 * | 10/2005 | Smith | E02B 3/14 405/20 |
| 9,797,106 | B1 * | 10/2017 | Smith | E02B 3/14 |
| 11,555,284 | B1 * | 1/2023 | Smith | E02D 17/20 |
| 11,661,716 | B1 * | 5/2023 | Jonassen | E02B 3/123 405/20 |
| 2003/0017000 | A1 * | 1/2003 | Jansson | E02B 3/123 405/16 |
| 2008/0075535 | A1 * | 3/2008 | Han | E02B 3/14 405/16 |

* cited by examiner

ANTI-ICE PUSHING/PULLING DEVICE INSTALLED ON SLOPE OF EARTH-ROCK DAM AND ICE THRUST CALCULATION METHOD

CROSS-REFERENCE TO RELATED APPLICATION

This application claims the priority benefit of China application serial no. 202211681117.1, filed on Dec. 27, 2022. The entirety of the above-mentioned patent application is hereby incorporated by reference herein and made a part of this specification.

BACKGROUND

Technical Field

The present invention relates to the technical field of water conservancy engineering, and particularly relates to an anti-ice pushing/pulling device installed on the slope of an earth-rock dam and an ice thrust calculation method.

Description of Related Art

The earth-rock dam slope is vulnerable to damage by frost and ice. In an aspect, the cycle of frost heaving and thaw settlement will increase the slope protection gap, resulting in the failure of a reversed filter layer and a cushion layer; and in a further aspect, an ice pressure will cause ice climbing or pushing against the slope, thus resulting in damage to the dam slope. Therefore, freezing damage to earth-rock dam slopes is a common problem.

SUMMARY

A first objective of the present invention is to provide an anti-ice pushing/pulling device installed on the slope of an earth-rock dam to solve the problem of freezing damage to the slope of an earth-rock dam. The device is capable to prevent ice pushing/pulling damage to the slope of an earth-rock dam. A second objective of the present invention is to provide an ice thrust calculation method.

In an aspect, the present invention provides an anti-ice pushing/pulling device installed on the slope of an earth-rock dam, and the device is arranged in a groove formed on the surface of an upstream slope of the earth-rock dam in the winter water level change area;

- the anti-ice pushing/pulling device includes an upper concrete slab and a lower concrete slab hinged by means of a rotating shaft structure, where the rotating shaft structure is located at the end of the groove in the upstream slope far away from the dam crest; a jack is arranged between the two concrete slabs to adjust the flip angle of the upper concrete slab;
- a plurality of rectangular grooves are formed on the surface of the upper concrete slab, and a combined structure formed by splicing concrete blocks is arranged in the rectangular grooves; and holes are formed on the concrete blocks.

Furthermore, the maximum flip angle of the upper concrete slab is 90° to the horizontal plane, and the minimum flip angle of the upper concrete slab is the angle of the dam slope to the horizontal plane.

Further, the concrete block is in the form of an isosceles right triangle, its hypotenuse is provided with an isosceles trapezoidal hole symmetric about the symmetry axis, and occlusal parts are formed on both sides of the isosceles trapezoidal hole; and the occlusal parts are used for occlusal splicing between the concrete blocks.

Further, the holes formed on the concrete blocks include small triangular holes located at two 45° angles of the concrete block, small circular holes located at the right angle of the concrete block, and two large triangular holes at the main body portion of the concrete block.

Further, the formed holes are symmetric about the symmetry axis of the concrete block.

Furthermore, in view that the sharp angles of the two large triangular holes on the concrete block shrink upward along the slope direction and are most vulnerable to damage by ice pushing, the two large triangular holes are rounded.

Furthermore, for a plurality of anti-ice pushing/pulling devices arranged on the surface of an upstream slope of the earth-rock dam, adjacent upper concrete slabs are connected by hinges to realize synchronous flip.

Further, a water-stop material is arranged on an edge of the lower concrete slab away from the rotating shaft structure to prevent water from flowing into the interlayer between the two concrete slabs.

In a further aspect, the present invention provides an ice thrust calculation method, the anti-ice pushing/pulling device described in the first aspect is adopted for the slope of the earth-rock dam, and the ice thrust F of the slope of the earth-rock dam is calculated via the equation (1):

$$F = 285\alpha\sqrt{1+m^2}\,(h-0.35)^{\frac{1}{6}}\left(\frac{\nabla t}{T}\right)^{0.1}\left[\left(\frac{2000h}{\sqrt[3]{v}\,H^{0.1}}-360\right)^{\frac{1}{12}}-0.72\right] \quad (1)$$

where F is the ice thrust; a is the material coefficient of the upper concrete slab, $a=a_1*a_2*a_3$, $a_1$ is the surface roughness, $a_2$ is the shape coefficient, $a_3$ is the contact condition coefficient; m is the slope of the upper concrete slab; h is the maximum ice thickness of the very day; ($\nabla t/T$) is the temperature rise rate, $\nabla t$ is the absolute value of the difference between the average temperature and the maximum or minimum temperature of the day; T is the temperature rise time; v is the average wind speed; and H is the water depth in front of the dam.

Because the anti-ice pushing/pulling devices are arranged in the grooves formed on the slope surface of the earth-rock dam in the winter water level change area, the calculation of the ice thrust on the slope of the earth-rock dam means the calculation of the ice thrust on the upper concrete slab.

In the past, calculation of ice thrust on the dam slope could only be performed by interpolation based on empirical values specified in the Specification. Inspection results show that the ice thrust calculation method provided by the present invention accords with the Specification and has strong practicability.

Further, the maximum ice thickness $h_0$ after cutting is calculated via the equation (2):

$$h_0 = \left(1 - K_1\frac{c_1 d}{s} - K_2\frac{\theta_1}{\theta}\right)h \quad (2)$$

where $h_0$ is the maximum ice thickness after cutting; $K_1$ and $K_2$ are coefficients; $C_1$ is the perimeter of a vertical projected area of all unfilled parts of rectangular grooves of the upper concrete slab on the dam slope; d is the thickness of the concrete block; S is the projected area of the upper concrete slab on the dam slope; $\theta_1$ is the angle between the upper concrete slab and the horizontal plane after flipping and unfolding; $\theta$ is the angle between the upstream slope and the horizontal plane; and the maximum ice thickness $h_0$ after cutting is substituted into the equation (1) to calculate the ice thrust after cutting.

If the ice thrust after cutting is not ideal, further adjustments can be made to the angle of the upper concrete slab and the groove structure, and the above equation can be used to check again.

A working principle of the present invention is as follows.

When the ice pushing/pulling phenomenon occurs, the upper concrete slab is the main object of stress, which mainly causes wear to the concrete block, thus avoiding direct damage to the dam slope.

By adjusting the angle of the upper concrete slab, its slope is changed, so that ice thrust can be reduced. The angle of the upper concrete slab can be changed so that the anti-ice pushing/pulling device has strong adaptability, which can meet the application conditions of earth-rock dams with different slopes in different climate regions in winter.

Under the condition that the groove depth of the upper concrete slab is changed, if no phenomenon of freezing occurs very soon after the device installation, and the ice does not climb into the upper concrete slab, then the maximum ice thickness is that disclosed in the public data; when complete freezing occurs and the ice fills the grooves of the upper concrete slab, the maximum ice thickness is reduced; the deeper the groove is, the more ice can be retained, and the better the ice thickness cutting effect is.

Compared with the prior art, the present invention has the following significant advantages and beneficial effects:

(1) the damage to the dam slope by ice pushing/pulling can be avoided, and the service life of the dam slope is prolonged;

(2) with regard to maintenance of the device, only the worn concrete block or the upper concrete slab needs to be replaced, which is easy to operate and low in cost; and (3) during the flood season, the anti-ice pushing/pulling device can be used as a wave-dissipation slope protection structure, which has the functions of reducing wave runup and preventing erosion.

BRIEF DESCRIPTION OF THE DRAWINGS

In order to describe the technical solutions in embodiments of the present invention more clearly, the accompanying drawings required in the description of the embodiments will be described below briefly. Apparently, the accompanying drawings in the following description are merely some embodiments of the present invention, and other drawings can be derived from these accompanying drawings by those of ordinary skill in the art without creative efforts.

DESCRIPTION OF THE EMBODIMENTS

The technical solutions in the embodiments of the present invention will be clearly and completely described below in combination with the accompanying drawings in the embodiments of the present invention. Apparently, the embodiments described are not all of the embodiments of the present invention. Based on the described embodiments of the present invention, all other embodiments acquired by those of ordinary skill in the art without making creative efforts fall within the protection scope of the present invention.

Figure 1:
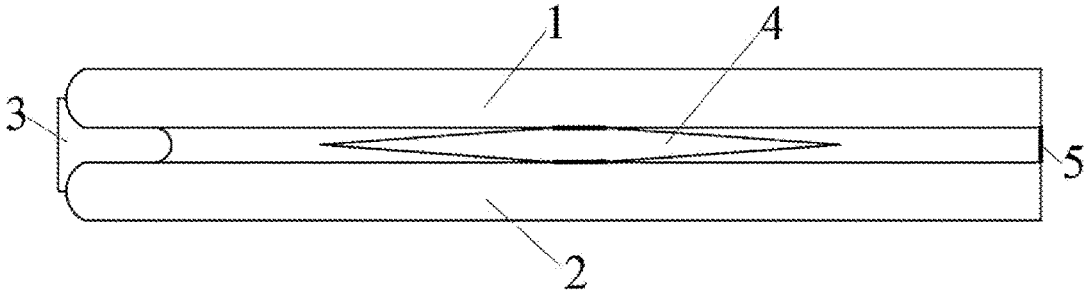
FIG. 1 is a schematic diagram of the structure of an anti-ice pushing/pulling device according to an embodiment of the present application.

As shown in FIG. 1, an anti-ice pushing/pulling device installed on the slope of an earth-rock dam is disclosed in an embodiment of the present application. The device includes an upper concrete slab 1 and a lower concrete slab 2 that have the same shape, size and thickness and are connected by means of a rotating shaft structure 3, and a water-stop material 5 is arranged on an edge of the lower concrete slab 2 away from the rotating shaft structure 3. A jack 4 is arranged in the interlayer between the upper concrete slab 1 and the lower concrete slab 2, and the jack 4 is fixed on the lower concrete slab 2 for driving the upper concrete slab 1 to flip.

In this embodiment, the upper concrete slab 1 is rectangular, 1 m long and 0.64 m wide, and its thickness is 0.4 times the thickness of a dam slope protective layer.

Figure 2:
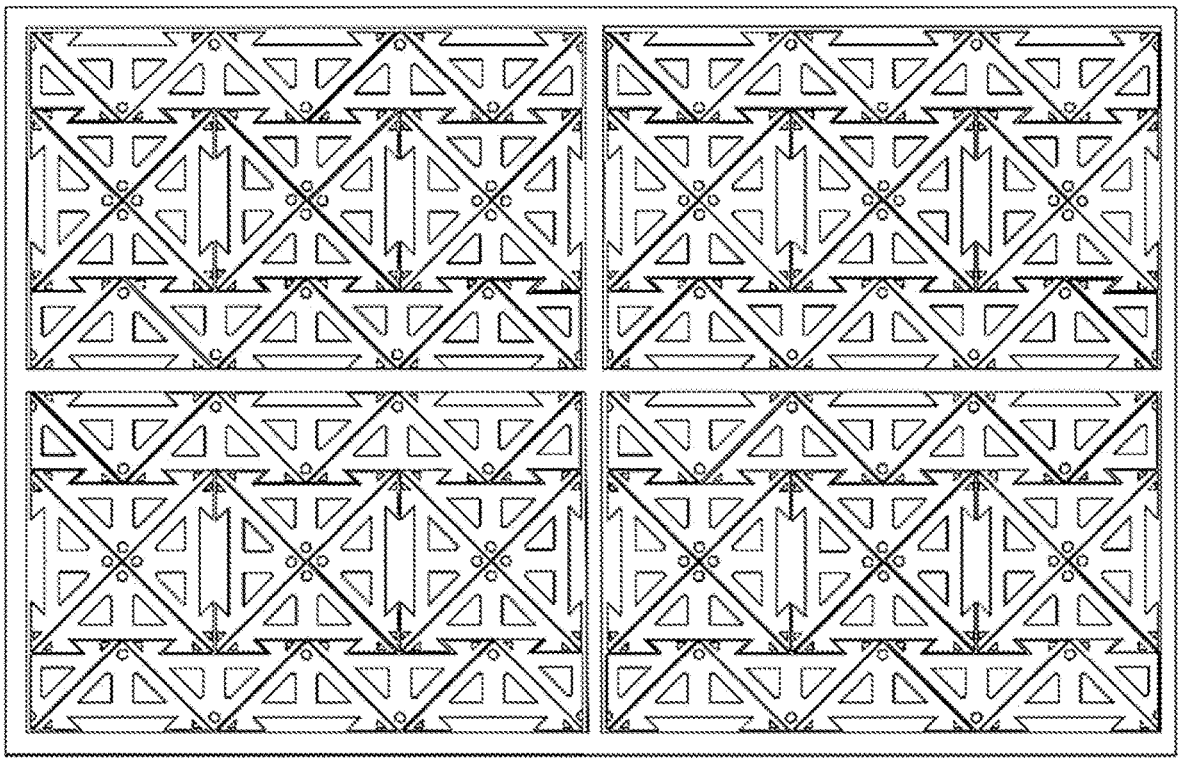
FIG. 2 is a schematic diagram of the structure of an upper concrete slab according to an embodiment of the present application.
Figure 3:
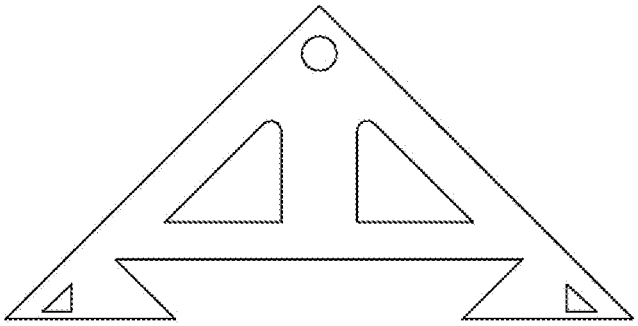
FIG. 3 is a schematic diagram of the structure of a concrete block according to an embodiment of the present application.
Figure 4:
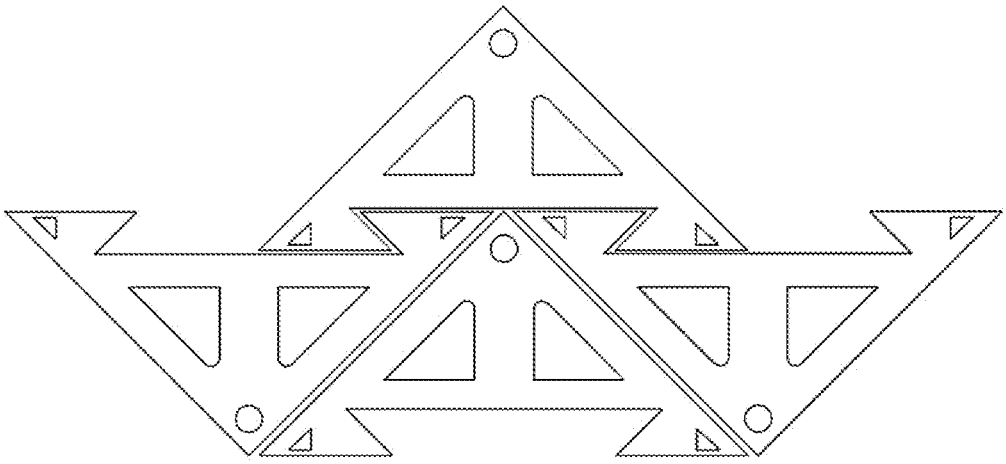
FIG. 4 is a schematic diagram of a splicing structure between concrete blocks according to an embodiment of the present application.

Referring to FIG. 2 to FIG. 4, the upper surface of the upper concrete slab 1 is provided with four rectangular grooves that are equal in depth and area and are symmetric about the two symmetry axes of a panel. The distance from a rectangular groove to an edge of the panel and to one adjacent rectangular groove is 5 cm. A combined structure formed by splicing 24 concrete blocks is arranged in each of the four rectangular grooves. In this embodiment, the concrete blocks are made of hydraulic concrete.

The concrete block is in the form of an isosceles right triangle, an isosceles trapezoid symmetric about the symmetry axis is cut out from its hypotenuse, and occlusal parts are formed on both sides of the isosceles triangular hole; and the occlusal parts are used for occlusal splicing between the concrete blocks. The length of the lower base of the isosceles triangular hole cut off by the concrete block should be slightly greater than the sum of the lengths of the remaining two sections after the trapezoid is cut off by the hypotenuse of the isosceles right triangle, as shown in FIG. 3. A small triangle is cut out at 45° angles on both sides of the concrete block, a small circle is cut out at the top right angle of the concrete block, and two large triangles are cut out at the left and right positions of the center line. The small circle and the isosceles triangular hole cut out are axisymmetric along the center line, and the cut-out pairs of triangles, one large and one small, are symmetric about the center line. In view that the sharp angles of the two large triangular holes on the concrete block shrink upward along the slope direction and are most vulnerable to damage by ice pushing, the two large triangular holes are rounded.

In a single rectangular groove, the concrete blocks are divided into three rows along the width direction of the rectangle. In the upper row or the lower row, three concrete blocks whose bottom edges are closely attached to the edge of the groove are placed first, and then the remaining two concrete blocks are embedded after aligning the right angles at the two intersection points with those of the two concrete blocks. That is, either of the two rows is provided with 5 concrete blocks. The middle row is composed of 3 similar rectangular patterns, and each pattern consists of 4 concrete blocks, indicating 12 concrete blocks in total. The remaining four corners of the rectangular groove are filled with semi-concrete blocks obtained by cutting the concrete blocks along the symmetry axis, and each corner is filled by 2 concrete blocks.

Figure 5:
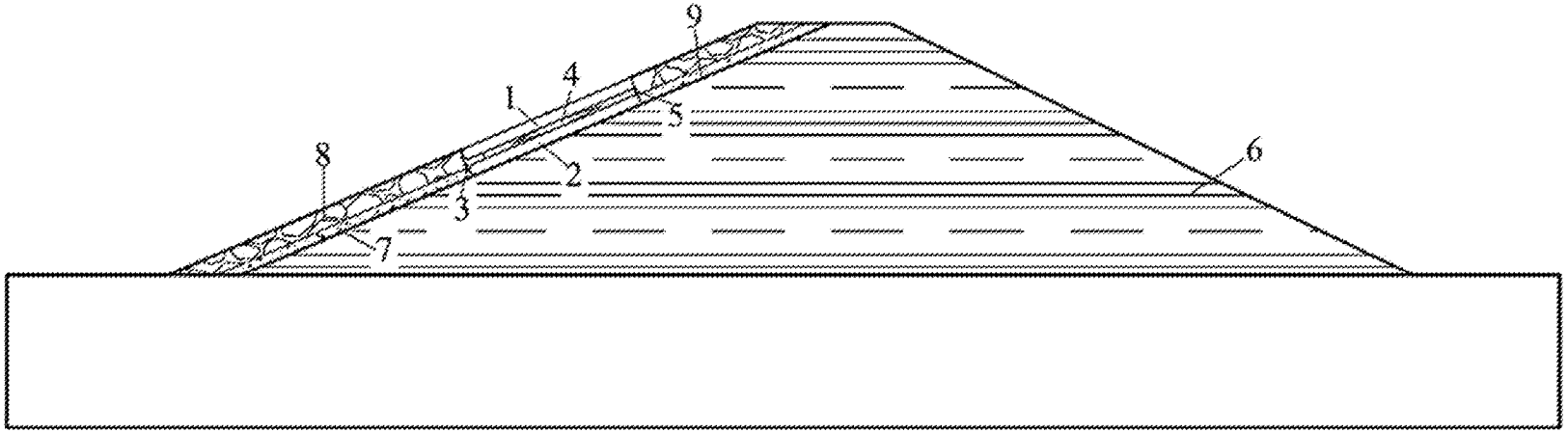
FIG. 5 is a schematic diagram of the structure of the anti-ice pushing/pulling device installed on the slope of an earth-rock dam according to an embodiment of the present application.

FIG. 5 is a schematic diagram of the structure of the anti-ice pushing/pulling device installed on the slope of an earth-rock dam. The earth-rock dam includes a dam body filling layer 6, and a geomembrane 9, an inverted layer 7, and an upstream protection slope 8 are arranged on the upstream side of the earth-rock dam. Rectangular grooves are excavated on the upstream slope protection surface of the earth-rock dam in the winter water level change area. The long side of the groove is parallel to the horizontal plane, its length is equal to the length of an upstream dam section, its width is equal to the width of the lower concrete slab 2, and its depth is equal to the thickness of the dam slope protection layer. The elevation of the top of the groove slightly exceeds the highest water level in winter in previous years.

The anti-ice pushing/pulling device is installed in the excavated groove, the lower concrete slab 2 is located below, and the rotating shaft structure 3 is located at the end of the dam slope groove away from the dam crest. The maximum flip angle of the upper concrete slab 1 is 90° to the horizontal plane, and the minimum flip angle of the upper concrete slab 1 is the angle of the dam slope to the horizontal plane.

Figure 6:
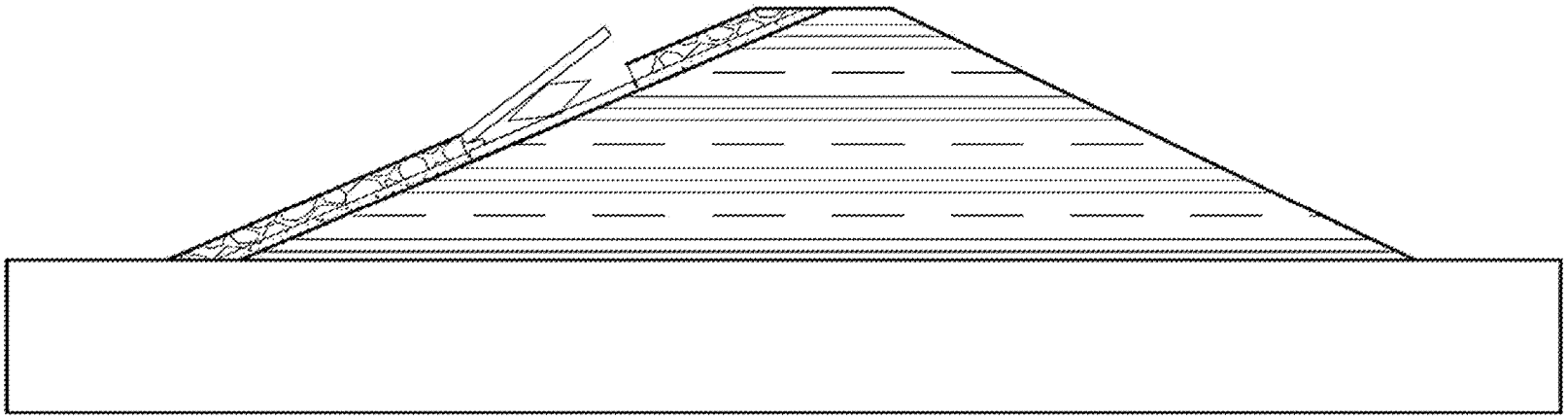
FIG. 6 is a schematic diagram of the usage state of the anti-ice pushing/pulling device in FIG. 5.

When there is no freezing phenomenon and the water level is high in summer, the upper concrete slab 1 is completely folded, and the water-stop material 5 is capable to prevent water from flowing into the interlayer. At this time, the anti-ice pushing/pulling device plays the role of reducing wave runup and preventing erosion. After the water surface is frozen in winter, the upper concrete slab 1 is unfolded, the water-stop material 5 is removed, and the jack 4 is used to jack up the upper concrete slab 1, as shown in FIG. 6.

When a plurality of anti-ice pushing/pulling devices are arranged on the upstream side of the earth-rock dam, the adjacent upper concrete slabs 1 are connected by hinges to achieve linkage when the plurality of the upper concrete slabs 1 are unfolded.

The embodiment of the present application further provides an ice thrust calculation method, and the anti-ice pushing/pulling device installed on the slope of an earth-rock dam described in the embodiment of the present application is adopted to protect the slope of the earth-rock dam.

Because the anti-ice pushing/pulling devices are arranged in the grooves formed on the slope surface of the earth-rock dam in the winter water level change area, the calculation of the ice thrust on the slope of the earth-rock dam means the calculation of the ice thrust on the upper concrete slab 1.

The ice thrust F acting on the dam slope, i.e. on the upper concrete slab 1, is calculated via the equation (1):

$$F = 285\alpha\sqrt{1+m^2}\,(h-0.35)^{\frac{1}{6}}\left(\frac{\nabla t}{T}\right)^{0.1}\left[\left(\frac{2000h}{\sqrt[3]{v}\,H^{0.1}}-360\right)^{\frac{1}{12}}-0.72\right] \quad (1)$$

where F is the ice thrust, kN/m; a is the material coefficient of the upper concrete slab 1, $a=a_1*a_2*a_3$, $a_1$ is the surface roughness, $a_2$ is the shape coefficient, and $a_3$ is the contact condition coefficient; m is the slope of the upper concrete slab 1; h is the maximum ice thickness of the very day, m; ($\nabla t/T$) is the temperature rise rate, $\nabla t$ is the absolute value of the difference between the average temperature and the maximum or minimum temperature of the day, ° C.; T is the temperature rise time, h; v is the average wind speed, m/s; and H is the water depth in front of the dam, m.

The above temperature rise time T is generally 6 h from 8:00 am to 14:00 pm.

The maximum ice thickness $h_0$ (i.e. after the action of the anti-ice pushing/pulling device) after cutting is calculated via the equation (2):

$$h_0 = \left(1 - K_1\frac{C_1 d}{S} - K_2\frac{\theta_1}{\theta}\right)h \quad (2)$$

where $h_0$ is the maximum ice thickness after cutting, m; $K_1$ and $K_2$ are coefficients; $C_1$ is the perimeter of a vertical projected area (on the dam slope) of all unfilled parts of rectangular grooves formed on the upper concrete slab 1, m; d is the thickness of the concrete block, m; S is the projected area of the upper concrete slab 1 on the dam slope, $m^2$; $\theta_1$ is the angle between the upper concrete slab 1 and the horizontal plane after flipping and unfolding, rad; $\theta$ is the angle between the upstream dam slope and the horizontal plane, rad.

In this embodiment, $C_1/C_2=7.75$ can be obtained based on the splicing method, where $C_2$ refers to the perimeter of the upper concrete slab 1.

The maximum ice thickness $h_0$ after cutting is substituted into the equation (1) to calculate the ice thrust after cutting.

A specific example is given below to further illustrate the above ice thrust calculation method.

According to public data, the maximum ice thickness of the earth-rock dam over the years is 0.8 m, the minimum temperature on that day is −15° C., the average temperature is −10° C., the average wind speed is 5 m/s, the water depth in front of the dam is 10 m, the slope of the upstream dam slope is 1:2, and the length of the retaining dam section is 20 m.

The depth of the rectangular groove on the upper concrete slab 1 of the anti-ice pushing/pulling device is 8 cm, the surface roughness $a_1$ of the concrete blocks filled in the rectangular groove is 1.2, the shape coefficient $a_2$ is 1.5, and the contact condition coefficient $a_3$ is 0.5.

The upper concrete slab 1 is unfolded to a slope of 1:1.9, and $K_1$ and $K_2$ are 0.1 and 0.15 respectively.

The ice thrust of the earth-rock dam just when the anti-ice pushing/pulling device is arranged is calculated first. According to the Specification for Load Design of Hydraulic Structures (SL744-2016), the ice thrust at this time is 215 kN, and the ice thrust obtained via the equation (1) is 227.20 kN, which meets the requirements.

Figure 7:
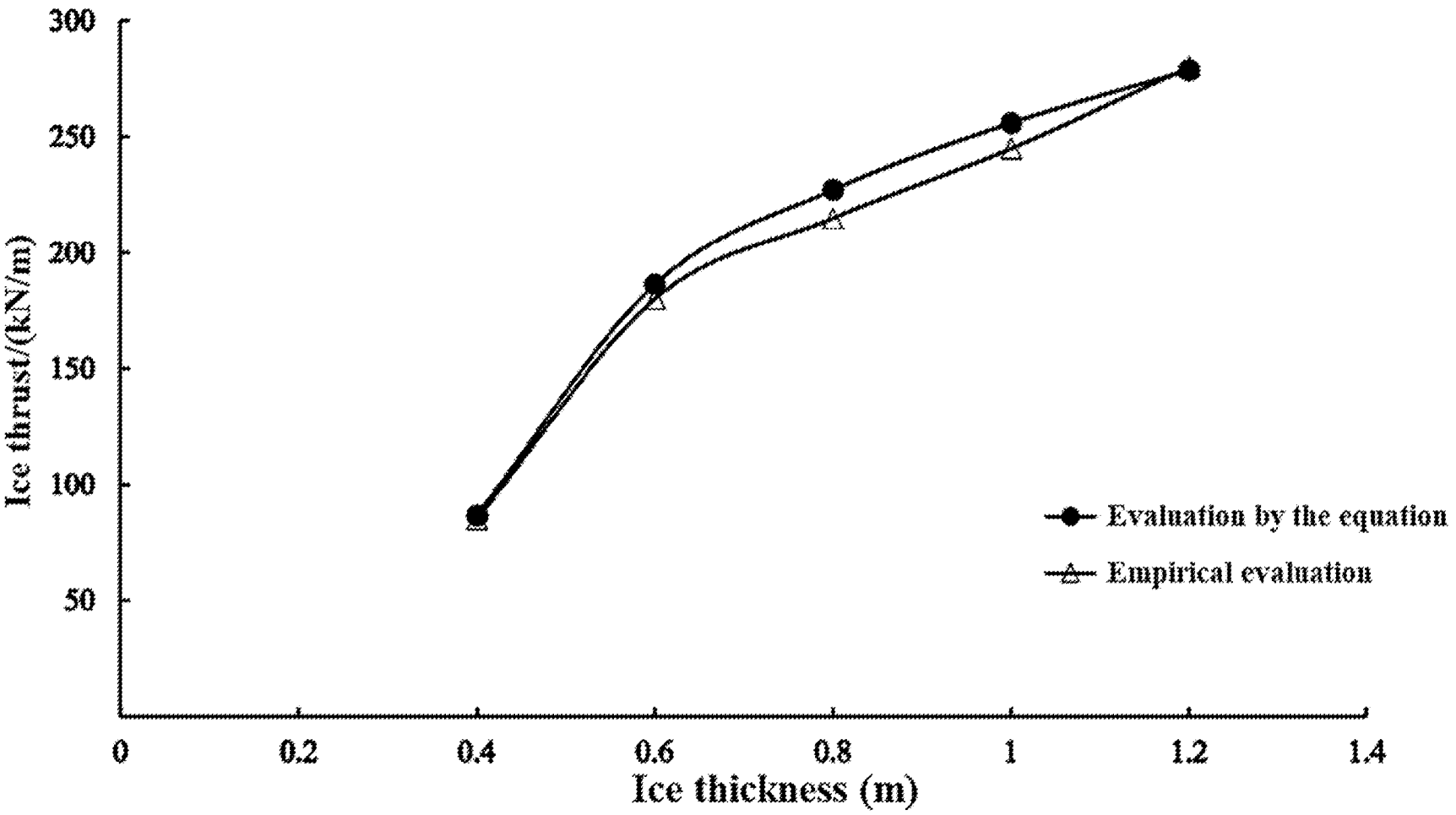
FIG. 7 is a comparison chart of calculation results of ice thrust according to an embodiment of the present application.

Furthermore, when the ice thicknesses are 0.4 m, 0.6 m, 1.0 m, and 1.2 m, the ice thrust is calculated via the equation (1) and is compared with the static ice pressure value given in the Specification for Load Design of Hydraulic Structures (SL744-2016). The comparison results are shown in Table 1 and FIG. 7. It can be seen that the calculation result from the equation is in close proximity to the value in the Specification.

TABLE 1

| Ice thickness (m) | Evaluation by the equation/(kN/m) | Empirical evaluation/(kN/) | Error percentage |
|---|---|---|---|
| 0.4 | 86.619 | 85 | 1.90% |
| 0.6 | 186.267 | 180 | 3.48% |
| 0.8 | 227.200 | 215 | 5.67% |
| 1.0 | 255.970 | 245 | 4.48% |
| 1.2 | 278.753 | 280 | 0.45% |

After freezing for a period of time, the ice thickness after cutting by the anti-ice pushing/pulling device per unit length calculated.

$$h_0=0.8\times(1-0.1\times0.08\times7.75\times1.64\times2\div0.64-0.15\times0.523333\div0.436111)=0.402\text{ m}$$

Calculation results show that the anti-ice pushing/pulling device has a more significant effect on cutting the ice thickness. At this time, the ice thrust F is calculated to be 87.187 kN via the equation (1). Therefore, it can be seen that the anti-ice pushing/pulling device can significantly reduce the ice thrust so as to protect the slope of the earth-rock dam.

When the present invention is implemented, the following steps can be followed.

First, basic data of the dam site area are collected, including air temperature, ice thickness, water level, wind speed, etc., and the ice thrust on the dam slope is calculated via the equation (1).

Then, an anti-ice pushing/pulling device that can meet the technological requirements is designed, the ice thickness after cutting is calculated via the equation (2), and the equation (1) is used to check and determine whether the adjustment angle and groove structure of the upper concrete slab can achieve the expected anti-ice pushing/pulling effect. If such effect cannot be achieved, this step is repeated until the anti-ice pushing/pulling device can meet the requirements.

Then, an anti-ice pushing/pulling device is made; and rectangular grooves are excavated on the surface of the dam slope in the winter water level change area. The long side of the groove is parallel to the horizontal plane, its length is equal to the length of an upstream dam section, its width is equal to the width of the lower concrete slab of the device, and its depth is equal to the thickness of the dam slope protection layer. The elevation of the top of the groove slightly exceeds the highest water level in winter in previous years. The lower concrete slab of the device is aligned with the short side of the groove of the dam slope to be perfectly embedded, so as to fill the groove with the device.

Finally, the upper concrete slab is unfolded to the designed angle to reduce the maximum ice thickness and ice thrust on the dam slope.

The foregoing descriptions are merely preferred specific implementations of the present invention, and are not intended to limit the protection scope of the present invention. Any equivalent substitutions or changes made by a person skilled in the art easily within the technical scope disclosed in the present invention shall fall within the protection scope of the present invention. Therefore, the protection scope of the present invention should be subject to a protection scope of the claims.

What is claimed is:

1. An anti-ice pushing/pulling device installed on a dam slope of an earth-rock dam, is arranged in a groove formed on a surface of an upstream dam slope of the earth-rock dam in an area whose water level varies between a maximum level and a minimum level during winter;

the anti-ice pushing/pulling device comprises an upper concrete slab and a lower concrete slab hinged by means of a rotating shaft structure, wherein the rotating shaft structure is located at an end of the groove on the dam slope, and the end of the groove is more distant from a dam crest than another end of the groove opposite to the end of the groove; a jack is arranged between the upper concrete slab and the lower concrete slab to adjust a flip angle of the upper concrete slab;

a plurality of rectangular grooves are formed on a surface of the upper concrete slab, and a combined structure formed by splicing concrete blocks is arranged in the rectangular grooves; and holes are formed on the concrete blocks;

a maximum flip angle of the upper concrete slab is 90° to a horizontal plane, and a minimum flip angle of the upper concrete slab is an angle of the dam slope;

each of the concrete blocks is in a form of an isosceles right triangle, a hypotenuse of each of the concrete blocks is provided with an isosceles trapezoidal hole symmetric about a symmetry axis, and occlusal parts are formed on both sides of the isosceles trapezoidal hole; and the occlusal parts are used for occlusal splicing between the concrete blocks;

a water-stop material is arranged on an edge of the lower concrete slab away from the rotating shaft structure to prevent water from flowing into an interlayer between the upper concrete slab and the lower concrete slab;

wherein the anti-ice pushing/pulling device is configured to resist an ice thrust F on the dam slop of the earth-rock dam, and the ice thrust F is calculated by an equation as follows, $$F = 285\alpha\sqrt{1+m^2}\,(h-0.35)^{\frac{1}{6}}\left(\frac{\nabla t}{T}\right)^{0.1}\left[\left(\frac{2000h}{\sqrt[3]{v}\,H^{0.1}}-360\right)^{\frac{1}{12}}-0.72\right]$$

wherein F is the ice thrust, kN/m; a is a material coefficient of the upper concrete slab, $a=a_1*a_2*a_3$, $a_1$ is a surface roughness, $a_2$ is a shape coefficient, $a_3$ is a contact condition coefficient, $a_1$ is 1.2, $a_2$ is 1.5, and $a_3$ is 0.5; m is a slope of the upper concrete slab; h is a maximum ice thickness of a day, m; ($\nabla t/T$) is a temperature rise rate, $\nabla t$ is an absolute value of a difference between an average temperature and a maximum or minimum temperature of the day, ° C.; T is a temperature rise time, h; v is an average wind speed, m/s; and H is a water depth in front of the earth-rock dam, m;

wherein the anti-ice pushing/pulling device is configured to reduce a maximum ice thickness which is calculated as follows, $$h_0=\left(1-K_1\frac{C_1 d}{S}-K_2\frac{\theta_1}{\theta}\right)h$$

wherein $h_0$ is the maximum ice thickness after reduction, m; $K_1$ and $K_2$ are coefficients, and $K_1$ and $K_2$ are 0.1 and 0.15, respectively; $C_1$ is a perimeter of a vertical projected area of all unfilled parts of the rectangular grooves of the upper concrete slab on the dam slope, m; d is a thickness of each of the concrete blocks, m; S is a projected area of the upper concrete slab on the dam slope, $m^2$; $\theta_1$ is an angle between the upper concrete slab and the horizontal plane after flipping and unfolding, rad; $\theta$ is an angle between the upstream dam slope and the horizontal plane, rad; and the maximum ice thickness $h_0$ after reduction is substituted into the equation for the ice thrust to calculate the ice thrust after reduction.

2. The anti-ice pushing/pulling device installed on the dam slope of the earth-rock dam according to claim 1, wherein the holes are formed on each of the concrete blocks and comprise small triangular holes located at two 45° angles of each of the concrete blocks, a small circular hole located at a right angle of each of the concrete blocks, and two large triangular holes at a main body portion of each of the concrete blocks.

3. The anti-ice pushing/pulling device installed on the dam slope of the earth-rock dam according to claim 2, wherein the holes are symmetric about the symmetry axis of each of the concrete blocks.

4. The anti-ice pushing/pulling device installed on the dam slope of the earth-rock dam according to claim 2, wherein the two large triangular holes are rounded.

5. The anti-ice pushing/pulling device installed on the dam slope of the earth-rock dam according to claim 1, wherein for a plurality of anti-ice pushing/pulling devices arranged on the surface of the upstream dam slope of the earth-rock dam, the upper concrete slab and another upper concrete slab of another one of the anti-ice pushing/pulling devices adjacent to the upper concrete slab are connected by hinges to realize synchronous flip.

* * * * *